US006213315B1

(12) United States Patent
Forney et al.

(10) Patent No.: US 6,213,315 B1
(45) Date of Patent: Apr. 10, 2001

(54) STACKABLE BULK BAG SUPPORT RACK HAVING VERTICALLY EXTENDABLE FRAME

(75) Inventors: Thomas M. Forney, Macon; Dean A. Weber, St. Joseph, both of MO (US)

(73) Assignee: BKD Group, Inc., St. Joseph, MO (US)

( * ) Notice: Subject to any disclaimer, the term of this patent is extended or adjusted under 35 U.S.C. 154(b) by 0 days.

(21) Appl. No.: 09/419,795

(22) Filed: Oct. 18, 1999

(51) Int. Cl.[7] ..... A47F 7/00

(52) U.S. Cl. ..... 211/85.15; 211/194; 248/97; 248/99

(58) Field of Search ..... 211/12, 194, 190, 211/85.15, 207; 248/97, 95, 99, 163.2

(56) References Cited

U.S. PATENT DOCUMENTS

| | | | | |
|---|---|---|---|---|
| 110,511 | * | 12/1870 | Swogger . | |
| 495,728 | * | 4/1893 | Elliott . | |
| 1,923,816 | * | 8/1933 | Firl . | |
| 3,762,343 | * | 10/1973 | Thacker . | |
| 4,527,716 | * | 7/1985 | Haas et al. | 248/97 X |
| 4,934,636 | * | 6/1990 | Orlosky et al. | 248/95 |
| 4,966,311 | * | 10/1990 | Taylor . | |
| 5,217,125 | | 6/1993 | Swanson . | |
| 5,787,945 | * | 8/1998 | Riemersma | 248/100 X |
| 5,924,577 | | 7/1999 | Gessert . | |
| 5,951,228 | | 9/1999 | Pfeiffer et al. . | |
| 5,957,287 | | 9/1999 | Valenti et al. . | |

* cited by examiner

*Primary Examiner*—Robert W. Gibson, Jr.
(74) *Attorney, Agent, or Firm*—Hovey, Williams, Timmons & Collins

(57) ABSTRACT

The disclosed bulk bag storage rack facilitates both storage and unloading of a bulk bag and thereby eliminates the standard handling techniques heretofore required in transferring a bulk bag from a conventional rack to the bag unloader. The storage rack includes a bag suspension frame to which the bulk bag is attached. A base is shiftably intercoupled with the frame so as to permit vertical shifting between vertically expanded and contracted conditions. During storage, the rack is vertically contracted and the bag attached to the frame rests on the base, whereby the frame provides essentially no support to the bag. When it is desired to unload the bag, the frame is maintained at a desired height and the base is allowed to shift downwardly relative the frame. This eliminates the support provided by the base and the bag is consequently suspended from the frame. An unloading station includes a stand to support the frame at the desired height and a stop for limiting downward movement of the base.

18 Claims, 6 Drawing Sheets

STACKABLE BULK BAG SUPPORT RACK HAVING VERTICALLY EXTENDABLE FRAME

BACKGROUND OF THE INVENTION

1. Field of the Invention

The present invention relates generally to bulk bag support rack systems for facilitating storage of large bulk bags. More particularly, the present invention concerns a support rack that is designed to support a bulk bag during both storage and unloading. The present invention also particularly concerns a bulk bag storage and unloading system that includes a bag unloading station that cooperates with the inventive support rack to facilitate unloading of the bag supported by the rack.

2. Discussion of Prior Art

Bulk material (e.g., dog food, grain, etc.) will often be contained within large bags so as to facilitate transport, distribution and overall handling of the material. A standard bulk material bag typically includes a top material inlet and a bottom material outlet, such that material is loaded into the bag through the top inlet and unloaded through the bottom outlet. Furthermore, a bulk bag will often have an internal dimension of sixty-four cubic feet and be capable of holding as much as one ton of bulk material therein.

Those ordinarily skilled in the art will appreciate that bulk bags are unwieldy and that contact or direct handling of the bag is likely to risk bag punctures or complete bag failure. In this respect, a filled bag will typically be stored on a support rack that is designed to maintain the bag in an upright orientation. The support rack also permits the bag to be moved without the bag having to be contacted or directly handled. For example, the support rack may include a standard pallet-type base that can supported by the forks of a standard forklift. The filled bag supported on such a rack can consequently be moved without requiring any contact or direct handling. Conventional support racks are also typically configured to be stacked on top of one another so that the filled bags stored thereon are in effect stackable.

Even with such bag support rack systems, there is still the need to remove the bag from the support rack when it is desired to unload the bag. In other words, conventional support racks only facilitate storage of bulk bags and provide no support during or assistance with unloading of the bag. In most cases, the bag is lifted off the rack (e.g., by attaching the bag to a mobile lift such as an overhead chain hoist), moved by the lift to an unloading location (e.g., above the hopper of a screw conveyor), and then maintained in a suspended condition by the lift during unloading. Not only does suspension of the bag provide access to the bottom outlet, clogging is prevented and complete emptying of the bag is ensured.

OBJECTS AND SUMMARY OF THE INVENTION

Responsive to these and other problems, an important object of the present invention is to provide a bulk bag storage and unloading system that eliminates user contact and handling of the bag. In this respect, it is an important object of the present invention to provide a bag support rack that is capable of supporting the bag during both storage and unloading of the bag. It is also an important object of the present invention to provide a bag support rack that facilitates unloading of the bag. In addition, an important object of the present invention is to provide a bag unloading station that cooperates with the bag support rack to facilitate unloading of the bag. Yet another important object of the present invention is to provide a bag storage and unloading system that has a durable, inexpensive and simple construction.

In accordance with these and other objects evident from the following description of the preferred embodiment, the present invention concerns a bag support rack including a bag suspension frame attachable to the bag in such a manner that the attached bag can be suspended from the frame. The rack also includes a base having a support surface configured to support the attached bag thereon. The frame and base are shiftably intercoupled so as to permit relative vertical shifting. The rack may consequently be vertically expanded from a storage condition in which the attached bag is at least primarily supported on the support surface to an unloading condition in which the attached bag is suspended from the frame.

The present invention also concerns a bag unloading station including a stand that is configured to support the frame and the attached bag. The stand includes a stop configured to engage the base, when the frame is supported on the stand and the rack is in the vertically expanded unloading condition, so as to prevent further downward shifting of the base relative to the frame. In this respect, if the frame and base are permitted to shift freely relative to one another between the storage and unloading conditions of the rack, the frame may be placed on the stand and the base will automatically drop relative to the frame to the unloading condition of the rack. The bag will then be suspended from the frame and ready for unloading.

Other aspects and advantages of the present invention will be apparent from the following detailed description of the preferred embodiments and the accompanying drawing figures.

BRIEF DESCRIPTION OF THE DRAWING FIGURES

A preferred embodiment of the invention is described in detail below with reference to the attached drawing figures, wherein.

DETAILED DESCRIPTION OF THE PREFERRED EMBODIMENT

Figure 1:
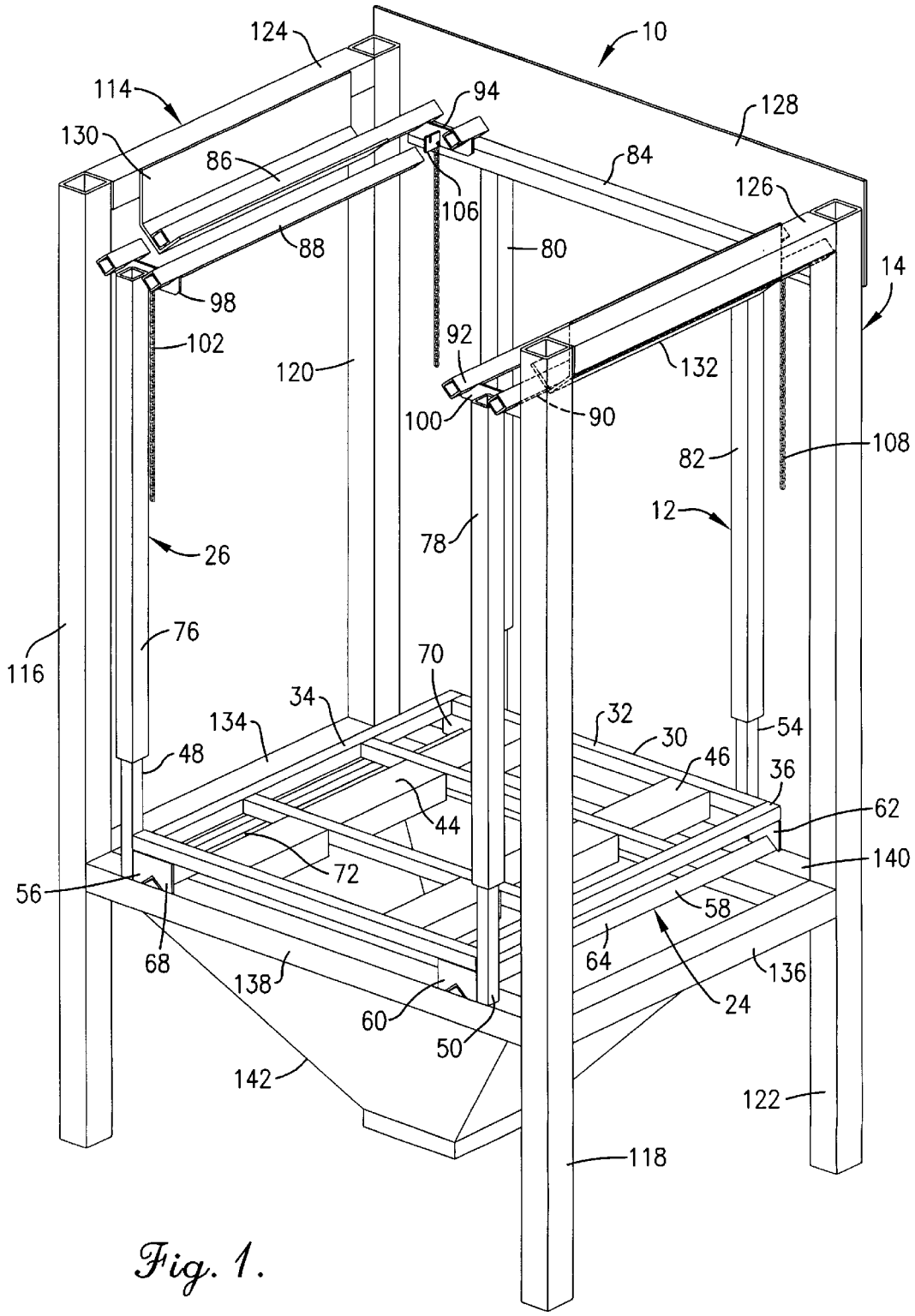
FIG. 1 is a perspective view of a bulk bag storage and unloading system constructed in accordance with the principles of the present invention.

Turning initially to FIG. 1, the bag storage and unloading system 10 selected for illustration generally includes a bag support rack 12 and a bag unloading station 14. As will subsequently be described, the support rack 12 is configured to support a large bulk material bag 16 during storage and unloading of the bag 16 (e.g., see FIGS. 4 and 5). Furthermore, the support rack 12 is supported within the station 14 during unloading of the bulk bag 16.

It is initially noted that the bulk bag 16 has a generally standard construction. Particularly, the preferred bulk bag 16 is formed of polypropylene and comprises a cylindrical outer wall 18 presenting open, top and bottom ends 20 and 22 (see FIGS. 4 and 5). In the usual manner, the bag 16 is preferably provided with a plastic liner (not shown). As shown in the drawing figures, the ends 20 and 22 are normally cinched to a closed condition by suitable means but are openable to permit loading and unloading of the bag 16. Typically, the top end 20 serves as a material inlet used to fill the bag 16, while the bottom end 22 serves as a material outlet through which material is discharged from the bag. The bag 16 is provided with four loops 24 spaced equally about the circumference of the outer wall 18 adjacent the top end 20. The loops 24 are fixedly attached to the outer wall 18 and are typically formed of the same material as the outer wall 18. As will subsequently be described, the loops 24 facilitate suspension of the bag 16 so that material may be discharged through the bottom end 22. Those ordinarily skilled in the art will appreciate that the bulk bag 16 is capable of containing a large amount of material (e.g., in excess of one ton); however, the principles of the present invention are equally applicable to various other bulk material bag shapes and designs. Furthermore, the illustrated bulk bag 16 is available and often sold under the designation "SUPER-SACK".

Figure 2:
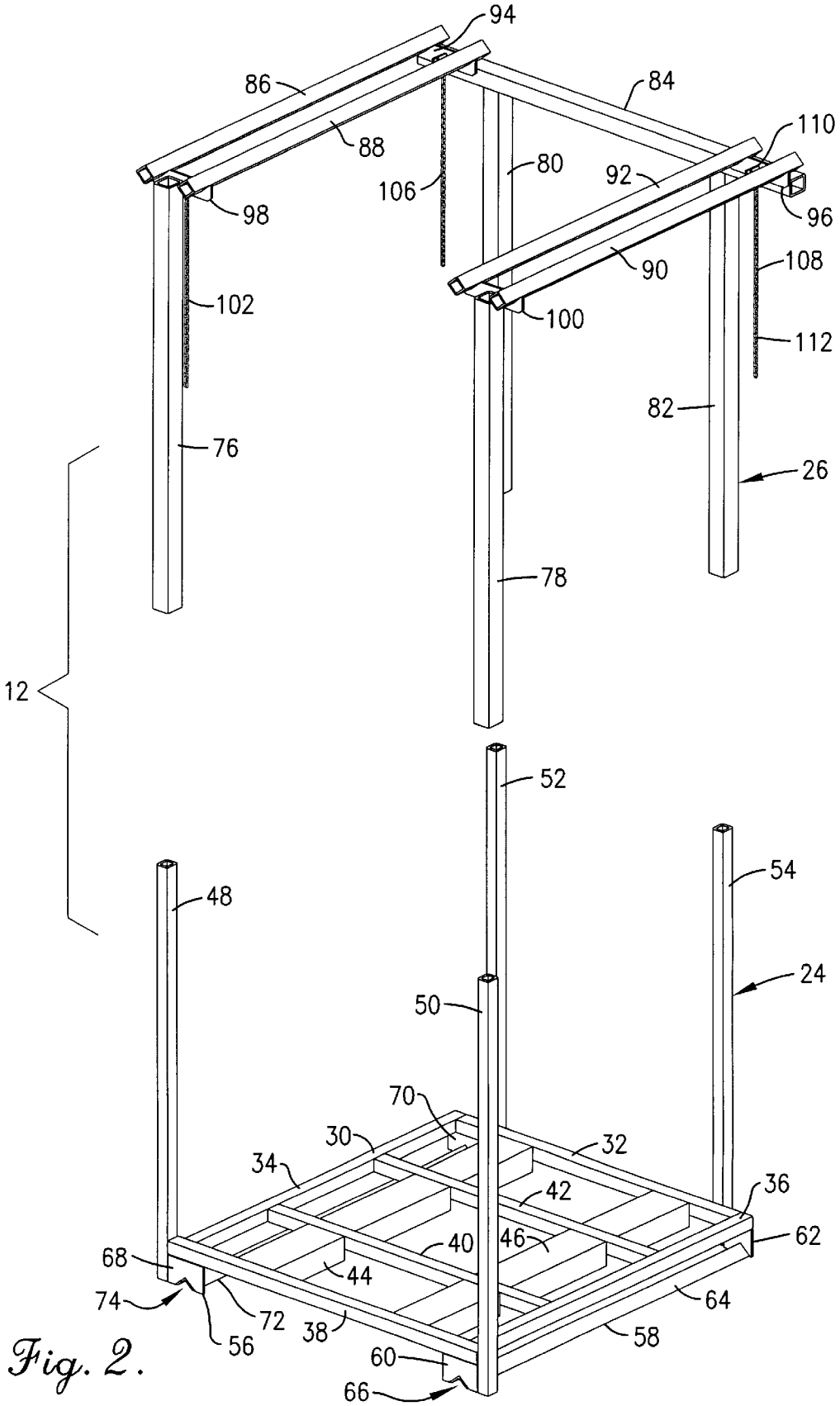
FIG. 2 is an exploded perspective view of the bulk bag support rack forming part of system shown in FIG. 1.

As particularly shown in FIG. 2, the support rack 12 comprises a lower base 26 and a upper bag suspension frame 28 that are intercoupled in such a manner that relative vertical shifting between the base 26 and frame 28 is permitted. As will be described further below, the support rack 12 is vertically expandable from a storage condition, in which the bag 16 is primarily supported by the base 26 (e.g., see FIG. 4), to an unloading condition, in which the bag 16 is suspended from the frame 28 and the base 26 provides essentially no support to the bag 16 (e.g., see FIG. 5). Furthermore, the unloading station 14 is designed to facilitate operation of the rack 12 as it expands from the storage condition to the unloading condition and during unloading of the bag 16.

The base 26 includes a platform 30 that presents a flat, horizontal support surface on which the bag 16 may be placed and thereby supported. The illustrated platform 30 comprises a lattice of steel elements, although other suitable platform configurations (e.g., a steel plate, a lattice formed of wood or high-strength plastic, etc.) are within the ambit of the present invention. In particular, the illustrated platform 30 includes a rear cross-rail 32 extending perpendicularly between the ends of a pair of parallel, equal-length side rails 34 and 36. A front cross-rail 38 is attached to the forward ends of the side rails 34 and 36 and is of sufficient length to project slightly outwardly beyond the side rails 34 and 36. A pair of intermediate cross-rails 40 and 42 are secured between the side rails 34 and 36 in such a manner that the cross-rail 40 is spaced the same distance from the front cross-rail 38 as the cross-rail 42 is spaced from the rear cross-rail 32. It is noted that the rails 32,34,36,38,40,42 are preferably formed of the same square-shaped tubular steel material. A pair of sectioned channel members 4.4 and 46 extend between the front and rear cross-rails 38,32, with the intermediate cross-rails 40,42 dividing each channel member 44 and 46 into three sections. The preferred channel members 44 and 46 are formed of inverted U-shaped pieces of steel material. The top surfaces of the rails 32,34,36,38, 40,42 and channel members 44,46 are at least substantially coplanar so as to cooperatively present the flat, horizontal bag support surface. The illustrated platform 30 is assembled by suitable means (e.g., mechanical fasteners, standard welding techniques, etc.).

The base 26 further includes four vertically oriented posts 48,50,52,54 which are preferably formed of the same material as the rails 32,34,36,38,40,42. The front posts 48 and 50 are attached to opposite ends of the front cross-rail 38 while the rear posts 52 and 54 are attached to the rear side of the rear cross-rail 32 at points spaced inwardly from the ends thereof. Thus, the posts 48,50,52,54 are disposed in a trapezoidal arrangement (when viewed from the top). The illustrated posts 48,50,52,54 are of equal length and are interconnected with the platform 30 so as to equally project upwardly and downwardly therefrom. The posts 48,50,52,54 and platform 30 are interconnected by suitable means (e.g., mechanical fasteners, standard welding techniques, etc.).

The base further includes a pair of fore-and-aft feet 56 and 58 that are specifically designed to facilitate stacking of the rack 12 with other similarly configured racks. Turning first to the right foot 58, a pair of notched plates 60 and 62 depend from the platform 30 so that their triangular-shaped notches are aligned along a fore-and-aft axis. An L-shaped bar 64 is secured within the notches of the plates 60 and 62, such that the right foot 58 presents a downwardly open, triangular-shaped fore-and-aft recess 66. The left foot 56 has a construction essentially identical to the right foot 58, and it shall therefore be sufficient to explain that the left foot 56 includes a pair of notched plates 68,70 and an L-shaped bar 72 that cooperatively define a downwardly open recess 74. The feet 56,58 and platform 30 are interconnected by suitable means (e.g., mechanical fasteners, standard welding techniques, etc.).

The bag suspension frame 28 includes four vertically oriented, tubular sleeves 76,78,80,82 each of which is configured to telescopically receive a respective one of the posts 48,50,52,54. The sleeves 76,78,80,82 are fixed relative to one another so that they synchronously slide along the posts 48,50,52,54. In the preferred embodiment, the top ends of the rear sleeves 80 and 82 are fixed to the underside of a rear cross-rail 84. The frame 28 further includes two uppermost pairs of fore-and-aft bars 86,88 and 90,92, with each pair of bars being attached to the rear cross-rail 84 by a respective bracket 94 and 96. The forward ends of the bars 86,88 and 90,92 are similarly attached to the tops of the sleeves 76 and 78 by brackets 98 and 100, respectively. The bars 86,88,90, 92 each comprise a square-shaped steel tube arranged so that its corners are disposed along the vertical and horizontal axes. In other words, the flat sides of each of the bars 86,88,90,92 are not horizontal and vertical, but rather are disposed at a 45° angle relative to the horizontal and vertical axes. It will be noted that the front sleeves 76 and 78 are slightly longer than the rear sleeves 80 and 82, although the brackets 94,96,98,100 are arranged so that the bars 86,88, 90,92 are generally level and do not slope downwardly toward the rear cross-rail 84. The foregoing components of the frame 28 are interconnected by suitable means (e.g., mechanical fasteners, standard welding techniques, etc.).

Figure 6:
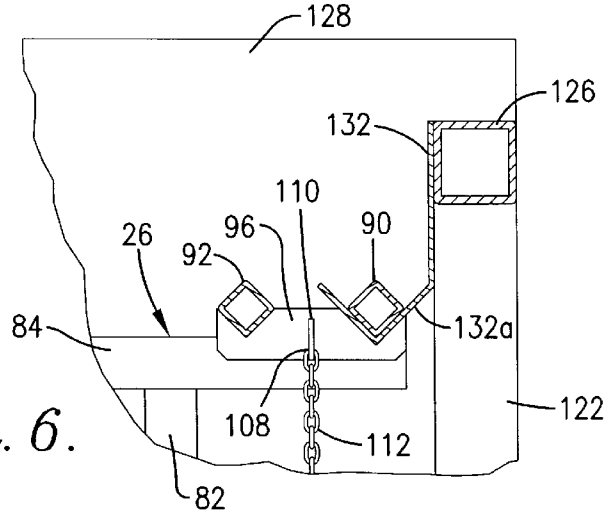
FIG. 6 is an enlarged, fragmentary cross-sectional view of bulk bag storage and unloading system, particularly illustrating the means by which the bag suspension frame is supported by the stand of the unloading station.

At each corner of the frame 28 is a chain assembly 102,104,106,108 that serves to attach the frame 28 to the bag 16. As perhaps best shown in FIGS. 4 and 6, the right rear chain assembly 108 includes a hook element 110 projecting forwardly from the bracket 96. The chain assembly 108 further includes a chain 112 having one end fixed to the hook element 110 and an opposite end that can be releasably secured to the element 110. The remaining chain assemblies 102,104,106 are similarly constructed and will therefore not be described in detail.

Figure 8:
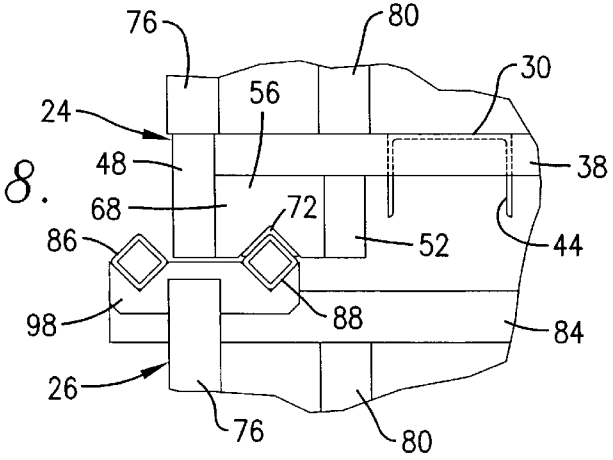
FIG. 8 is an enlarged, fragmentary front elevational view of the interlocking structure provided on the racks to ensure proper and secure stacking of the racks.
Figure 7:
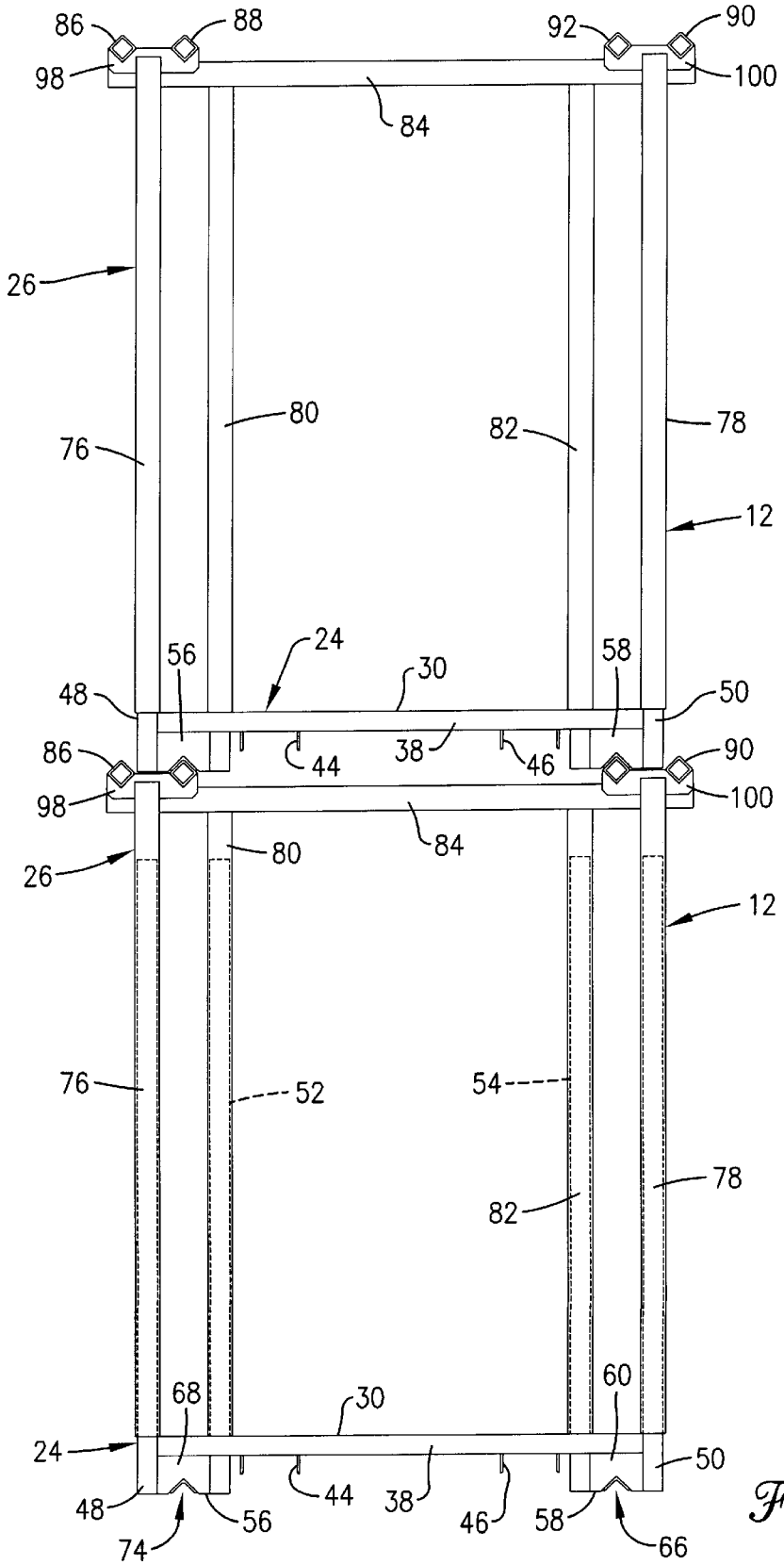
FIG. 7 is a front elevational view of a pair of stacked bulk bag support racks.

Each of the inner fore-and-aft bars 88 and 92 of the frame 28 presents an upwardly projecting, triangular shaped flange (i.e., the uppermost corner of each of the bars) that is dimensioned to fit matingly within the downwardly open recess 74 and 66 of the respective foot 56 and 58. That is to say, each of the innerbars 88 and 92 and the respective one of the recesses 74 and 66 are disposed along a common vertical plane (e.g., see FIG. 7). Because the system 10 will typically include a plurality of similarly configured racks, the feet 56 and 58 and bars 88 and 92 facilitate stacking of the racks. Such a stacked relationship is depicted in FIGS. 7 and 8, with the racks 12 and components thereof being referenced by the same numerals. It is particularly noted that the inner bars 88 and 92 of the lower rack are tightly received within the feet 56 and 58 of the upper rack. The upper rack is in fact supported on the bars 88 and 92 of the lower rack. Furthermore, the illustrated arrangement serves as a guide to facilitate proper stacking of the racks, with the user being permitted to place the upper rack on the lower rack and then make any adjustments in the fore-and-aft direction simply by sliding the feet 56 and 58 along the bars 88 and 92. In addition, the illustrated arrangement limits relative side-to-side shifting of the upper and lower racks.

Again, the base 26 and frame 28 are slidably interconnected so that the rack 12 can be vertically expanded and contracted. It is noted that the lower ends of the sleeves 76,78,80,82 abuttingly engage the platform 30 and thereby limit vertical contraction of the rack 12. As will subsequently be described, the frame 28 is designed so that bag 16 can be attached to but is not necessarily suspended from the frame 28 when the rack 12 is in the contracted condition (e.g., see FIG. 4). Downward movement of the base 26 relative to the frame 28 is not normally limited such that the base 26 and frame 28 can be disconnected. Accordingly, in a bulk bag storage and unloading system having a plurality of similarly configured racks, the bases and frames of the racks are interchangeable. In any case, the posts 48,50,52,54 and sleeves 76,78,80,82 are of sufficient length to permit vertical expansion of the rack 12 to a condition that causes the bag 16 to be suspended from the frame whereby the base 26 provides essentially no support to the bag 16 (e.g., see FIG. 5).

Figure 4:
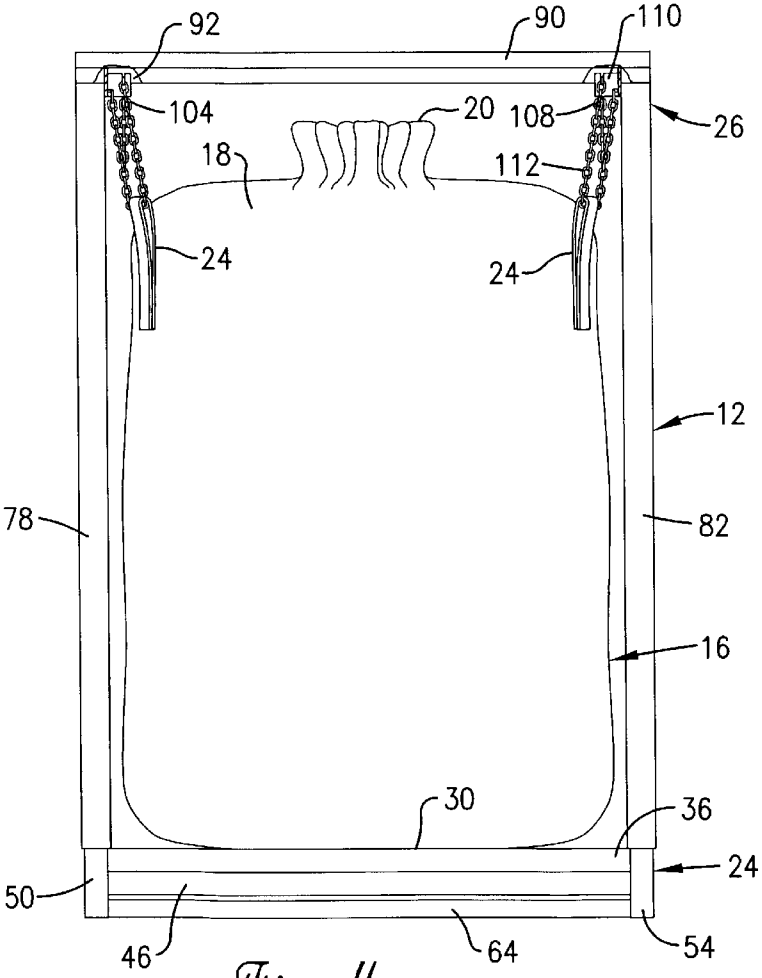
FIG. 4 is a side elevational view of the bulk bag support rack and a bag being supported primarily by the base, with parts being broken away to illustrate the manner in which the bag suspension frame is attached to the bag.

The bag 16 is preferably loaded onto the rack 12 when the latter is in the contracted condition. It is particularly noted that the bag 16 is conveniently loaded onto the rack 12 through the open front area defined above the platform 30. The relatively long front cross-rail 38 causes the front to be relatively wide and ensures that sufficient clearance is provided between the bag 16 and rack framework. Furthermore, the rear posts and sleeves 52,54 and 80,82 are spaced inwardly from the sides of the rack 12 (e.g., see FIG. 7) to limit rearward movement of the bag 16 and thereby prevent the bag 16 from falling off the rear of the rack 12. The bag is preferably arranged so that each of the loops 24 is adjacent one of the corners of the rack 12, and the chain 112 of each chain assembly 102,104,106,108 is passed through the adjacent loop 24 and secured to the respective hook element 110. The chains 112 are preferably drawn taut so as to assist in maintaining the bag 16 in an upright orientation but are not tightened to such a degree that the bag 16 is lifted off the platform 30, as shown in FIG. 4. Thus, when the rack 12 is in the contracted condition, the bag 16 rests on the platform 30 and is generally supported thereby. It is in this condition that the bag 16 is normally stored, and the rack 12 may be stacked with other bag-containing racks as shown in FIG. 7. Furthermore, vertical expansion of the rack 12 from the contracted, storage condition will quickly remove the weight of the bag 16 from the platform 30 and cause the bag 16 to be suspended from the frame 28. As indicated above, suspension of the bag 16 during unloading of its contents is desired. It is noted that the cinched bottom end 22 of the bag 16 is preferably located between the intermediate cross-rails 40,42 and channel members 44,46, such that the bottom end 22 may be opened and material may pass through the platform 30 (see FIG. 5). The open area defined between the intermediate cross-rails 40,42 and channel members 44,46 consequently defines a material passageway extending through the platform 30. The intermediate cross-rails 40,42 and channel members 44,46 also serve to prevent flailing movement of the bottom end 22 of the bag 16 which might otherwise occur during material discharge. Thus, the present invention not only permits the bag 16 to remain in the rack 12 during both storage and unloading, but also facilitates unloading of the bag 16. If desired, vertical contraction and expansion of the rack may be powered (e.g., by a hydraulic piston and cylinder assembly, a solenoid, etc.), although this is not required as will be described hereinbelow.

The present invention also concerns the bag unloading station 14 that is used with the support rack 12 to unload the contents of the bag 16. Particularly, the preferred bag unloading station 14 receives the rack 12 and serves to control vertical expansion of the rack 12. The station 14 may also be provided with structure for receiving, managing and/or conveying the material discharged from the bag 16.

Figure 3:
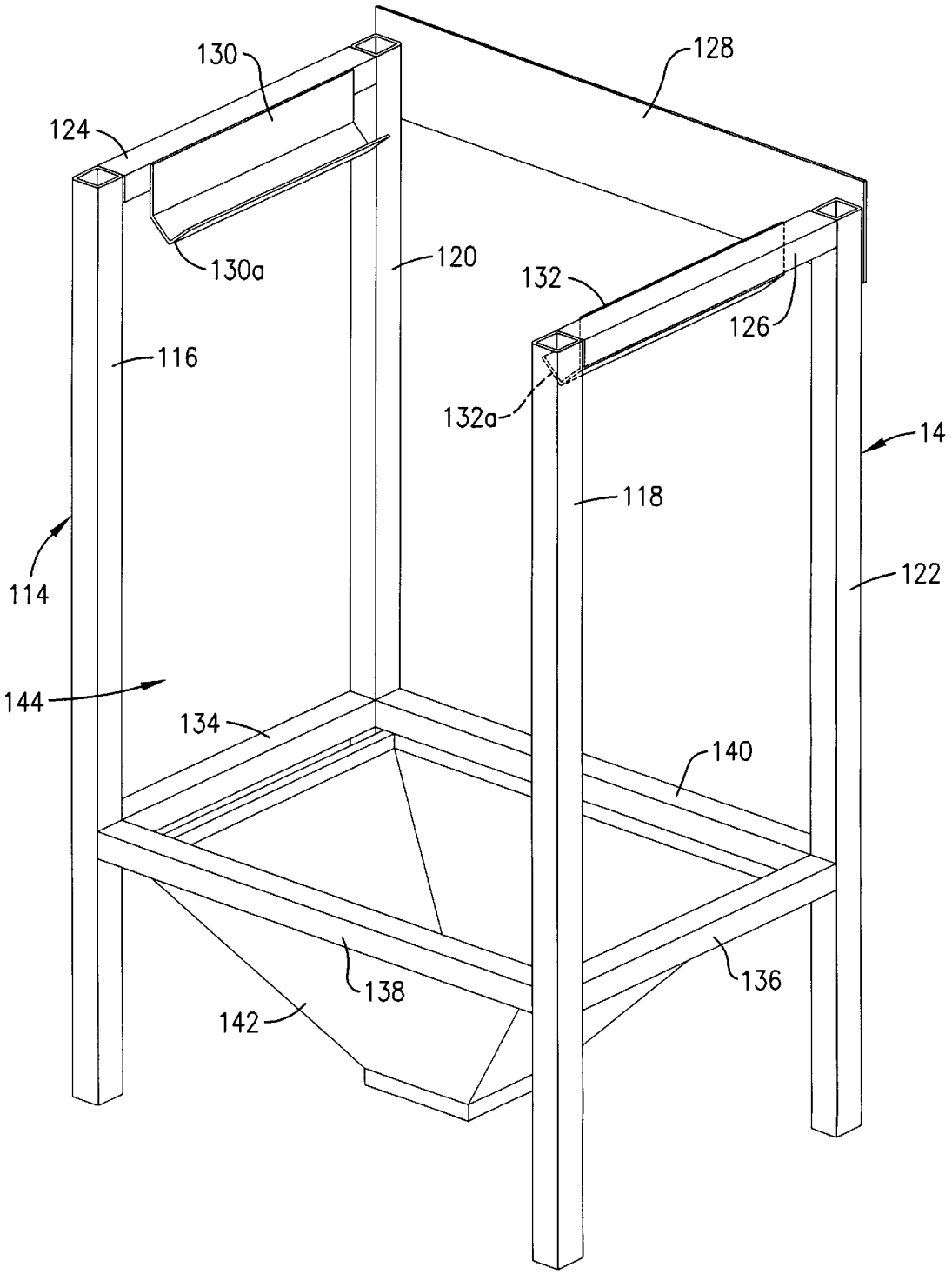
FIG. 3 is a perspective view of the bag unloading station forming part of the system shown in FIG. 1.

As shown in FIG. 3, the illustrated bag unloading station 14 includes a stand 114 comprising four equal-length legs 116,118,120,122 that are each preferably formed of a square-shaped steel tube. A fore-and-aft beam 124 is fixed between the upper ends of the left legs 116 and 120, and the right legs 118 and 122 are similarly interconnected by a fore-and-aft beam 126. A vertical plate 128 attached to the rear faces of the legs 120 and 122 extends across the rear of the stand 114 and projects slightly above the legs 120 and 122. The stand 114 further includes a pair of frame-supporting members 130 and 132, each depending from a respective one of the fore-and-aft beams 124 and 126. As perhaps best shown in FIG. 6, each of the frame-supporting members 130 or 132 presents a V-shaped shelf portion **130*a* or 132*a* that has a transverse configuration corresponding to the outer bars 86 and 90 of the frame 28. In fact, the outer bars 86 and 90 and members 130 and 132 are configured in such a manner that the bars 86 and 90 nest matingly on the members 130 and 132 (see FIGS. 1 and 6**).

Figure 5:
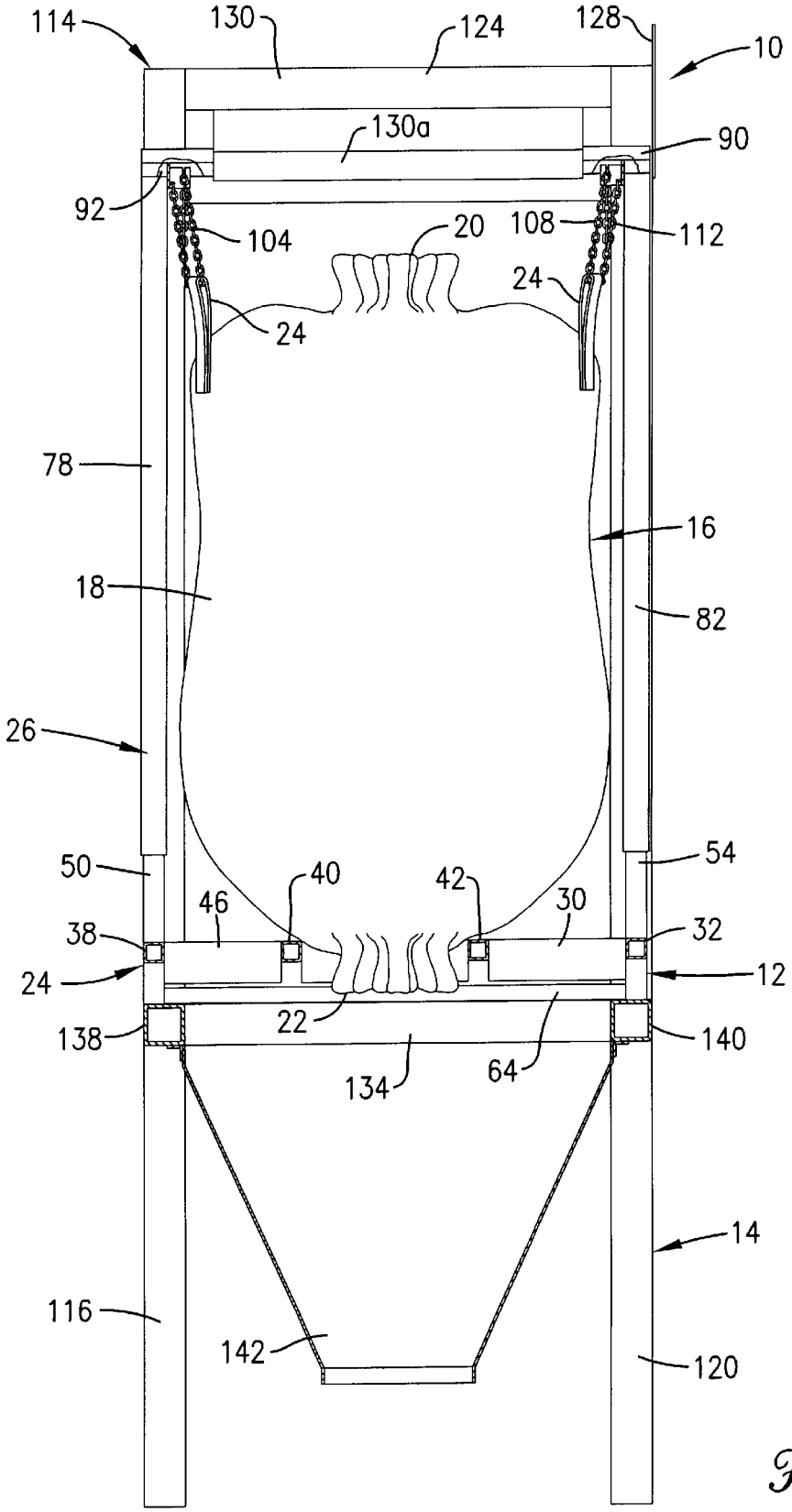
FIG. 5 is a vertical cross-sectional view of the bulk bag storage and unloading system, particurlarly illustrating a bag suspended within the rack during unloading of the bag contents.

The stand 114 further includes a pair of lower fore-and-aft beams 134 and 136 extending between and serving to interconnect the legs 116,120 and 118,122, respectively. Disposed along the same horizontal plane as the fore-and-aft beams 134,136 are front and rear cross-beams 138 and 140 extending between and interconnecting the front legs 116, 118 and rear legs 120,122, respectively. The beams 134,136, 138,140 are configured to engage the underside of the platform 30, as shown in FIGS. 1 and 5, and thereby limit downward movement of the base 26 relative to the frame 28 when the rack is received within the station 14. With the illustrated embodiment, when the frame 28 is supported by the stand 114 as a result of the bars 86 and 90 resting in the respective members 130 and 132, the base 26 will drop freely until it engages the beams 134,136,138,140. The stand 114 is assembled by suitable means (e.g., mechanical fasteners, standard welding techniques, etc.).

Fixed to the underside of the front and rear cross-beams 138 and 140 is a hopper 142 that is positioned to receive material discharged from the bottom end 22 of the bag 16, when the rack 12 and bag 16 are positioned within the station 14 (see FIG. 5). The hopper 142 serves to converge the discharged material as it flows downwardly. Those ordinarily skilled in the art will appreciate that the hopper 142 may be connected to any suitable device (e.g., a conduit, a material conveyor, etc.). In this respect, the illustrated station 14 may be placed over or form part of a conveying means such as a screw conveyor, belt conveyor, etc. The stand 114 and hopper 142 are interconnected by suitable means (e.g., mechanical fasteners, standard welding techniques, etc.).

It will be appreciated that the stand 114 presents an overall rectangular, box-like configuration. As previously indicated, the stand 114 also presents an open interior space 144 (see FIG. 3) that is configured to receive the bag support rack 12. The generally open front of the stand 114 facilitates movement of the rack 12 into and out of the interior space 144; that is, the rack 12 may be moved generally horizontally toward the rear of the stand 114. The rack 12 is typically moved through the open front and then dropped downwardly until the frame-supporting members 130 and 132 catch the outer bars 86 and 90 of the frame 28. The base 26 is then permitted to shift downwardly by gravity until it engages the beams 134,136,138,140. The bag 16 is consequently suspended from the frame 28 so that the weight of the material contained within the bag 16 is at least substantially removed from the base 26 (see FIG. 5).

The operation of the illustrated bag storage and unloading system 10 should be apparent from the foregoing description. Thus, it shall be sufficient to explain that the bag 16 is placed on the base 26 and attached to the frame 28 by the chain assemblies 102,104,106,108, preferably when the rack 12 is in the storage condition (as shown in FIG. 4). The bag 16 is thereafter moveable without requiring user contact or direct handling of the bag 16. It is also noted that the inverted U-shaped channel members 44 and 46 are conveniently configured to accept the forks of a standard forklift (not shown) for simplifying movement of the rack 12 and supported bag 16. If desired, the rack 12 and supported bag 16 may be stacked with other racks as shown in FIG. 7.

When it desired to unload the contents of the bag 16, the rack 12 is coupled with the unloading station 14 by moving the rack 12 through the open front of the stand 114 and into the interior space 144. It is noted that proper fore-and-aft placement of the rack within the stand 114 is facilitated by the vertical plate 128 which serves to limit rearward movement of the rack 12. As shown in FIG. 5, the rack 12 is properly oriented within the stand 114 when the rear margin of the frame 28 engages or is just in front of the plate 128. The rack 12 is subsequently dropped (e.g., by lowering the forks of the forklift) until the outer bars 86 and 90 of the frame 28 are caught by the respective frame-supporting members 130 and 132. The forks of the forklift may then be removed, and the base 26 will shift downwardly by gravity until it engages the beams 134,136,138,140. At this point, the bag 16 is suspended from the frame 28 and material may now be discharged through the bottom end 22 and into the hopper 142. Once the bag 16 is empty, the rack 12 is lifted from the stand 114 preferably by inserting the forks of the forklift under the base 26. This will normally cause the rack 12 to vertically collapse (until the sleeves 76,78,80,82 engage the platform 30) and the frame 28 will eventually be removed from the frame-supporting members 130 and 132. The empty bag may be removed from the rack 12 and the rack 12 may then be reused to support a new bag, or the empty bag may alternatively be refilled on the rack 12.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of the present invention as pertains to any apparatus not materially departing from but outside the literal scope of the invention as set forth in the following claims.

What is claimed is:

1. A bulk bag support rack for supporting a bulk bag that has a lower outlet and is configured to be suspended while material is discharged from the outlet, said rack comprising:

a bag suspension frame attachable to the bag in such manner that the attached bag can be suspended from the frame; and a base presenting a bag support surface configured to support the attached bag thereon, said base and frame being shiftably intercoupled so as to permit relative vertical shifting between a storage condition in which the attached bag is at least primarily supported by the support surface and a vertically expanded unloading condition in which the attached bag is suspended from the frame, said base and said frame being slidably interconnected in such a manner that the relative vertical shifting is generally unrestricted between the storage and unloading conditions, said base presenting a material passageway extending from the support surface and through the base so that material discharged from the outlet of the attached bag can pass through the base.

2. A bulk bag support rack as claimed in claim 1, said base and frame including cooperating, telescopically interfitted elements that serve to slidably interconnect the base and frame.

3. A bulk bag support rack for supporting a bulk bag that has a lower outlet and is configured to be suspended while material is discharged from the outlet, said rack comprising:

a bag suspension frame attachable to the bag in such manner that the attached bag can be suspended from the frame; and a base presenting a bag support surface configured to support the attached bag thereon, said base and frame being shiftably intercoupled so as to permit relative vertical shifting between a storage condition in which the attached bag is at least primarily supported by the support surface and a vertically expanded unloading condition in which the attached bag is suspended from the frame, said base and said frame being slidably interconnected in such a manner that the relative vertical shifting is generally unrestricted between the storage and unloading conditions, said base and frame including cooperating, telescopically interfitted elements that serve to slidably interconnect the base and frame, said elements including a plurality of upstanding posts that form part of the base, said element further including a plurality of upright tubular sleeves, each of which slidably receives one of the posts and forms part of the frame.

4. A bulk bag support rack as claimed in claim 3, said base including a generally horizontal platform that defines the support surface, said posts projecting from the platform, with the platform serving to limit upward sliding movement of the posts relative to the sleeves such that the platform prevents vertical contraction of the base and frame beyond the storage condition.

5. A bulk bag support rack as claimed in claim 4, said platform presenting a material passageway extending from the support surface and through the platform so that material discharged from the outlet of the attached bag can pass through the platform.

6. A bulk bag support rack for supporting a bulk bag that has a lower outlet and is configured to be suspended while material is discharged from the outlet said rack comprising:

a bag suspension frame attachable to the bag in such manner that the attached bag can be suspended from the frame; and a base presenting a bag support surface configured to support the attached bag thereon, said base and frame being shiftably intercoupled so as to permit relative vertical shifting between a storage condition in which the attached bag is at least primarily supported by the support surface and a vertically expanded unloading condition in which the attached bag is suspended from the frame, said frame including an elongated bag attachment chain and a hook to which at least one end of the chain can be removably secured.

7. A bulk bag support rack for supporting a bulk bag that has a lower outlet and is configured to be suspended while material is discharged from the outlet, said rack comprising:

a bag suspension frame attachable to the bag in such manner that the attached bag can be suspended from the frame; and a base presenting a bag support surface configured to support the attached bag thereon, said base and frame being shiftably intercoupled so as to permit relative vertical shifting between a storage condition in which the attached bag is at least primarily supported by the support surface and a vertically expanded unloading condition in which the attached bag is suspended from the frame, said frame including at least one first interlocking member and said base including at least one second interlocking member, said first and second interlocking members being configured to matingly interengage so as to facilitate stacking of the rack with other similarly configured racks.

8. A bulk bag support rack as claimed in claim 7, said at least one first interlocking member comprising a plurality of upwardly projecting flanges, said at least one second interlocking member comprising a plurality of feet, each presenting a downwardly open recess configured to matingly receive one of the flanges.

9. A bulk bag storage and unloading system for a bulk bag that has a lower outlet and is configured to be suspended while material is unloaded through the outlet, said rack comprising:

a bulk bag support rack including a bag suspension frame attachable to the bag in such manner that the attached bag can be suspended from the frame; and a base presenting a bag support surface configured to support the attached bag thereon, said base being vertically shiftable relative to the frame between a first position in which the attached bag is at least primarily supported by the support surface and a relatively lower second position in which the attached bag is suspended from the frame; and a bag unloading station including a stand configured to support the frame and the attached bag, said stand including a stop configured to engage the base, when the frame is supported on the stand and the base is in the second position, so as to prevent downward shifting of the base beyond the second position.

10. A bulk bag storage and unloading system as claimed in claim 9, said bag unloading station including a hopper fixed to the stand below the stop and configured to receive material unloaded through the outlet of the attached bag.

11. A bulk bag storage and unloading system as claimed in claim 9, said stand presenting an interior rack-receiving space in which the rack is located when the frame is supported by the stand, said rack further presenting an open front area through which the rack passes as it is moved laterally into and out of the rack-receiving space, said stand including a rear plate spaced from the open front area and configured for abutting engagement with the rack, such that the rear plate limits lateral movement of the rack in a direction corresponding to movement of the rack into the rack-receiving space.

12. A bulk bag storage and unloading system as claimed in claim 11, said stand including at least one frame-supporting member extending between the open front area and the rear plate, said frame including at least one bar that is configured to rest on the at least one frame-supporting member so that the frame is supported on the stand.

13. A bulk bag storage and unloading system as claimed in claims 9, said base and said frame being slidably interconnected in such a manner that vertical shifting of the base relative to the frame is generally unrestricted between the first and second positions, said base thereby being caused by gravity to shift to the second position when the frame is supported on the stand.

14. A bulk bag storage and unloading system as claimed in claim 13, said base and frame including cooperating, telescopically interfitted elements that serve to slidably interconnect the base and frame.

15. A bulk bag storage and unloading system as claimed in claim 14, said elements including a plurality of upstanding posts that form part of the base, said clement further including a plurality of upright tubular sleeves, each of which slidably receives one of the posts and forms part of the frame.

16. A bulk bag storage and unloading system as claimed in claim 15, said base including a generally horizontal platform that defines the support surface, said posts projecting from the platform, with the platform serving to limit upward sliding movement of the posts relative to the sleeves such that the platform prevents upward shifting of the base beyond the first position.

17. A bulk bag storage and unloading system as claimed in claim 16, said platform presenting a material passageway extending from the support surface and through the platform so that material discharged from the outlet of the attached bag can pass through the platform.

18. A bulk bag storage and unloading system as claimed in claim 9, said frame including an elongated bag attachment chain and a hook to which at least one end of the chain can be removably secured.

* * * * *